US008167301B2

(12) United States Patent
Nireki

(10) Patent No.: US 8,167,301 B2
(45) Date of Patent: May 1, 2012

(54) PAPER SHEET HANDLING DEVICE

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 12/921,919

(22) PCT Filed: Feb. 20, 2009

(86) PCT No.: PCT/JP2009/053098

§ 371 (c)(1),
(2), (4) Date: Sep. 10, 2010

(87) PCT Pub. No.: WO2009/113377

PCT Pub. Date: Sep. 17, 2009

(65) Prior Publication Data

US 2011/0006471 A1 Jan. 13, 2011

(30) Foreign Application Priority Data

Mar. 11, 2008 (JP) ..... 2008-060587

(51) Int. Cl.
*B65H 29/44* (2006.01)
*B65H 31/04* (2006.01)

(52) U.S. Cl. ..... 271/180; 271/181; 271/214

(58) Field of Classification Search ..... 271/180, 271/181, 214, 215
See application file for complete search history.

(56) References Cited

U.S. PATENT DOCUMENTS

| | | | | |
|---|---|---|---|---|
| 5,899,452 | A | 5/1999 | Walsh | |
| 6,241,240 | B1 * | 6/2001 | Bukhman | 271/214 |
| 6,948,607 | B2 * | 9/2005 | Ito et al. | 194/206 |
| 7,255,341 | B2 * | 8/2007 | Yoshioka et al. | 271/177 |
| 7,886,888 | B1 * | 2/2011 | Chien et al. | 194/206 |
| 7,946,576 | B2 * | 5/2011 | Deaville et al. | 271/176 |
| 2004/0119225 | A1 * | 6/2004 | Yamamiya | 271/180 |
| 2005/0189702 | A1 * | 9/2005 | Takeuchi | 271/180 |

FOREIGN PATENT DOCUMENTS

| | | |
|---|---|---|
| JP | 11 203533 | 7/1999 |
| JP | 2005 10961 | 1/2005 |

* cited by examiner

*Primary Examiner* — David H Bollinger
(74) *Attorney, Agent, or Firm* — Oblon, Spivak, McClelland, Maier & Neustadt, L.L.P.

(57) ABSTRACT

A paper sheet processing apparatus including a housing part capable of stacking a paper sheet in a stable condition. A bill processing apparatus includes: a bill housing part capable of stacking the bill having been inserted into a bill insertion slot. The bill housing part includes a regulatory member having an opening through which a bill to be received; and a contact face which regulates a movement of the bill by contacting. The regulatory member is configured to make a coefficient of friction on the contact face contacting the bill greater than a coefficient of friction caused between stacked and housed bills.

3 Claims, 10 Drawing Sheets

PAPER SHEET HANDLING DEVICE

FIELD OF THE INVENTION

The present invention relates to a paper sheet processing apparatus (or paper sheet handling device) comprising a housing stacker capable of housing a bill, a card, a coupon ticket, and so on (hereafter collectively referred to as "a paper sheet").

BACKGROUND ART

In general, a bill processing apparatus, which is one of the embodiments of the paper sheet processing apparatus, is incorporated into a service device such as a game medium rental machine installed in a game hall, a vending machine or a ticket-vending machine installed in a public space, or the like, which identifies the validity of a bill inserted from a bill insertion slot by a user and provides various types of products and services in accordance with a value of the bill having been judged as valid. Such a bill processing apparatus comprises a bill conveyance mechanism which conveys a bill inserted into a bill insertion slot, operation equipments such as a bill identification part which conducts validity judgment (or also referred to as authenticity judgment) whether the bill to be conveyed is valid or not, etc., and control means which drives and controls such operation equipments. Then, bills identified as being valid in the bill identification part are sequentially housed in a bill housing part (or bill housing stacker).

As such a bill housing stacker, for example, a configuration disclosed in Patent Reference 1 is known. As described in this publicly known technology, the bill housing part includes a bill supporting plate 50 on which a bill is placed, a pair of partition walls 4A and 4B against which the bill is pressed by the bill supporting plate 50, and a pressing plate 40 pressing the bill toward the bill supporting plate 50.

A passage opening 4C through which the bill is capable of passing is formed between the pair of partition walls 4A and 4B, and the bill is conveyed in a bill guiding part 4 between the pair of partition walls 4A, 4B and the pressing plate 40, and when the pressing plate 40 is driven in this state, the bill passes through the passage opening 4C as it deflects, whereby it is loaded on the bill supporting plate 50. Then, the bill is sequentially laminated on a bill stacking part 5 between the pair of partition walls 4A, 4B and the bill supporting plate 50, to be housed so as to be pressed and biased against the surfaces of the pair of partition walls 4A, 4B by a compression coil spring 51 pressing and biasing the bill supporting plate 50. In such a bill housing stacker, when a severely wrinkled or damaged bill, stiffness of which is deteriorated, is conveyed in, the central portion of the bill housed and stacked on the bill supporting plate is deflected to come down into the passage opening by impact and vibration in a housing operation, which may cause a mal-stacking of the bill.

[Patent Reference 1] Japanese Unexamined Patent Application Publication No. 2005-010961

DISCLOSURE OF THE INVENTION

Problem to be Solved by the Invention

Here, a paper sheet processing apparatus comprising a housing part capable of stacking a paper sheet in a stable condition is provided.

Means to Solve the Problem

In the present invention, a paper sheet processing apparatus includes a housing part which is capable of housing a paper sheet inserted into an insertion slot, and the housing part comprises a regulatory member including an opening for receiving a paper sheet to be stacked and housed, and a contact face for regulating movement of the paper sheet to which the paper sheet is contacted, and then the regulatory member is arranged such that a coefficient of friction on the contact face contacted by a paper sheet is higher than a coefficient of friction caused between paper sheets to be stacked and housed. Further features of the present invention, its nature, and various advantages will be more apparent from the accompanying drawings and the following description of the preferred embodiment.

DESCRIPTION OF NOTATIONS

Figure 1:
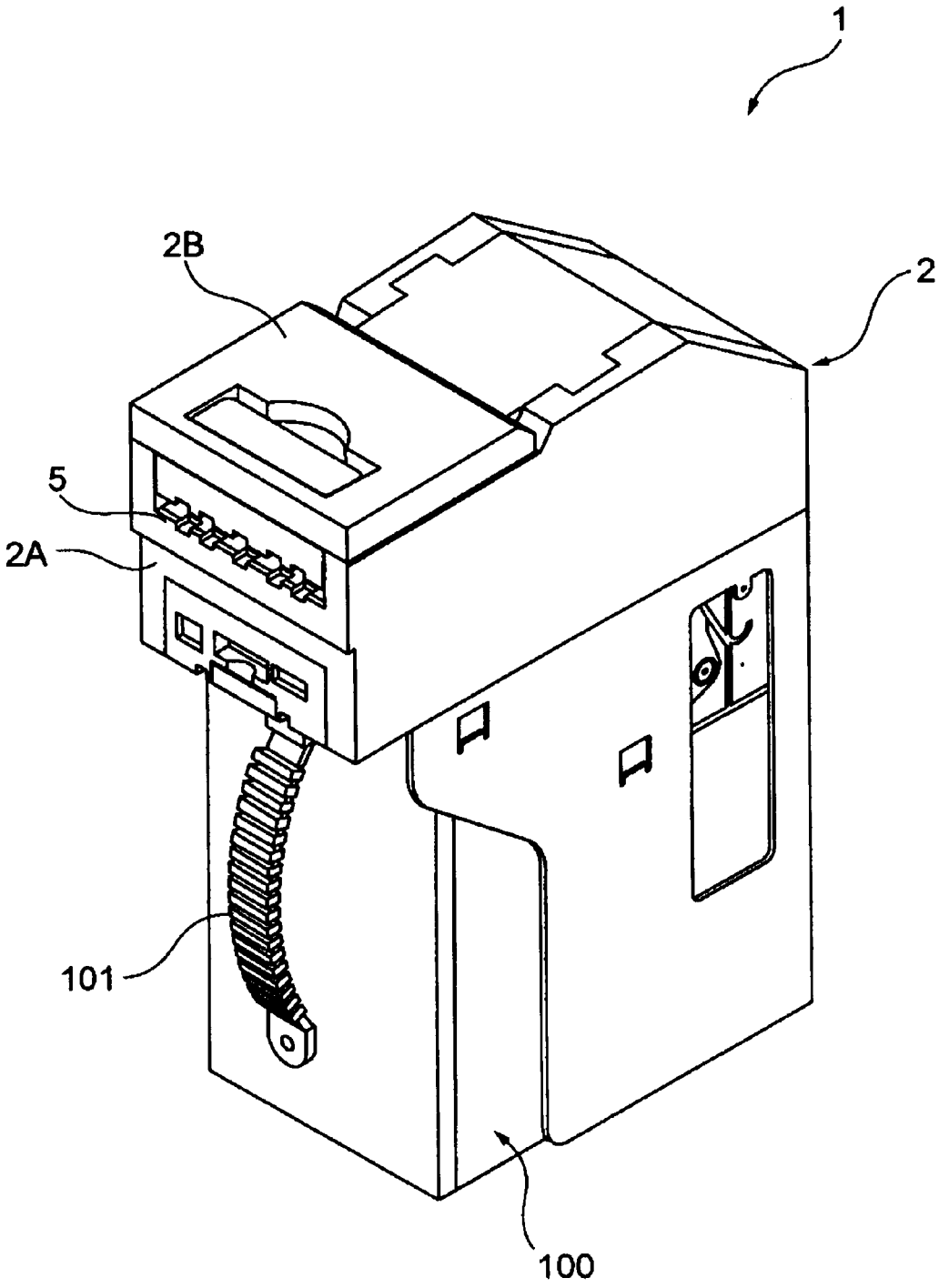
FIG. 1 is a perspective view showing an entire structure to illustrate an embodiment in which a paper sheet processing apparatus according to the present invention is applied to a bill processing apparatus.

1 bill processing apparatus
2 apparatus main body
3 bill traveling route
5 bill insertion slot
6 bill conveyance mechanism
8 bill reading means
10 skew correction mechanism
10A movable piece
13 motor
100 bill housing part
105 placing plate
105*a* contact face
110 regulatory member
110A opening
110*a* contact face

BEST MODE FOR CARRYING OUT THE INVENTION

Hereinafter, an embodiment of the present invention will be described with reference to the drawings.

Figure 2:
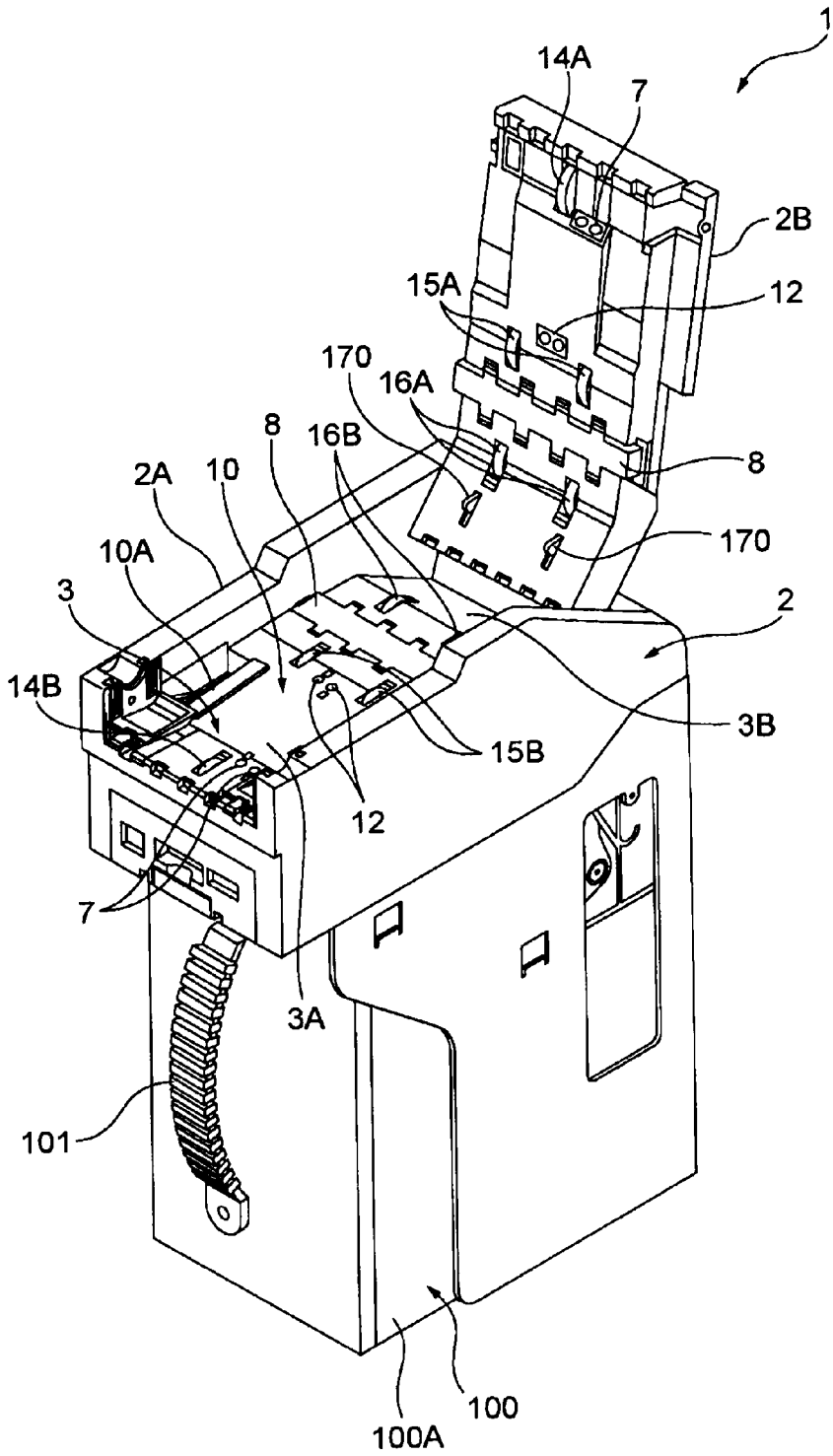
FIG. 2 is a perspective view showing the bill processing apparatus in a state that an open/close member is opened for a main body frame of an apparatus main body.
Figure 3:
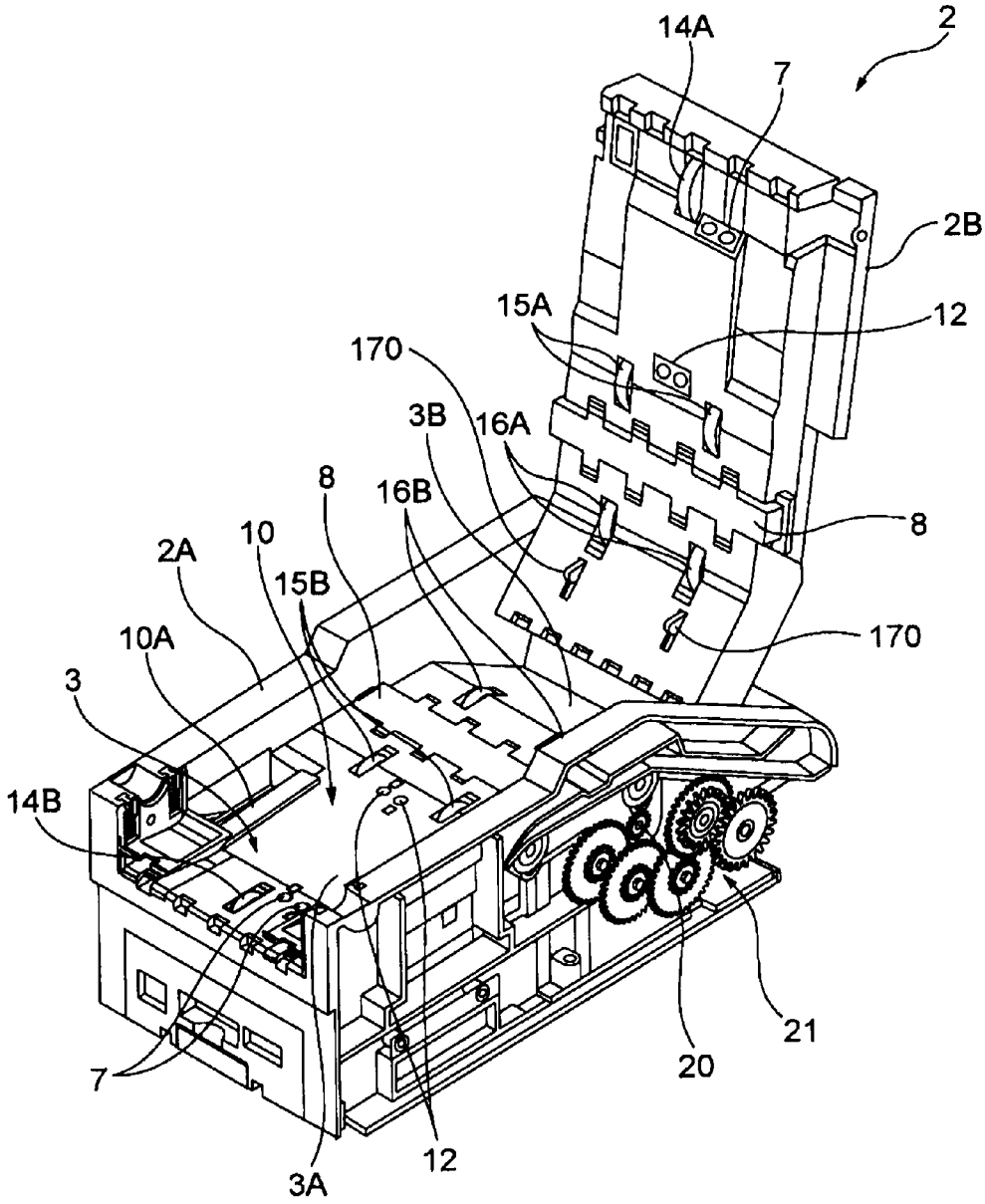
FIG. 3 is a perspective view showing a configuration of a power transmission part of the apparatus main body.
Figure 4:
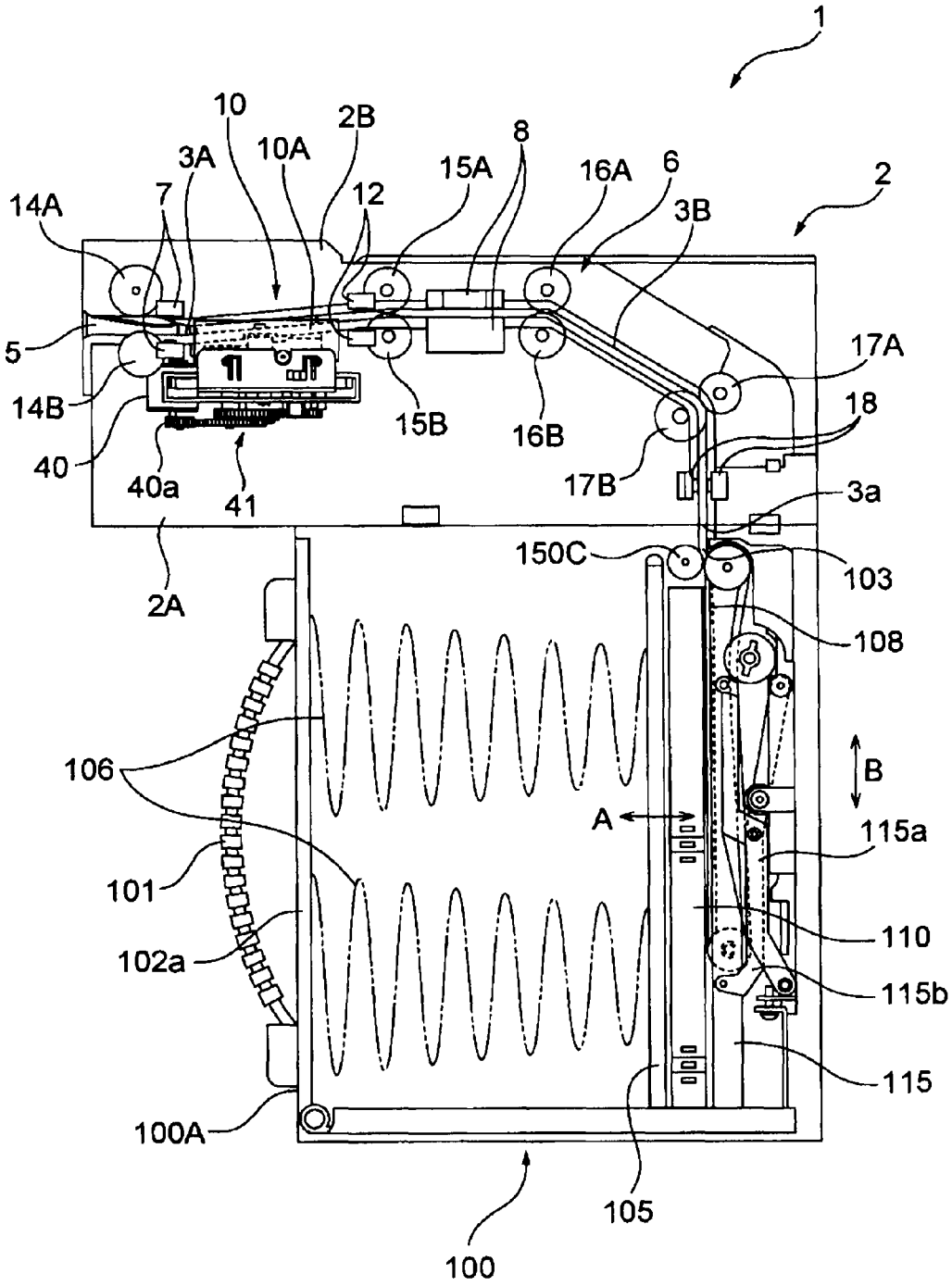
FIG. 4 is a right side view schematically showing a traveling route of a bill to be inserted from an insertion slot.
Figure 5:
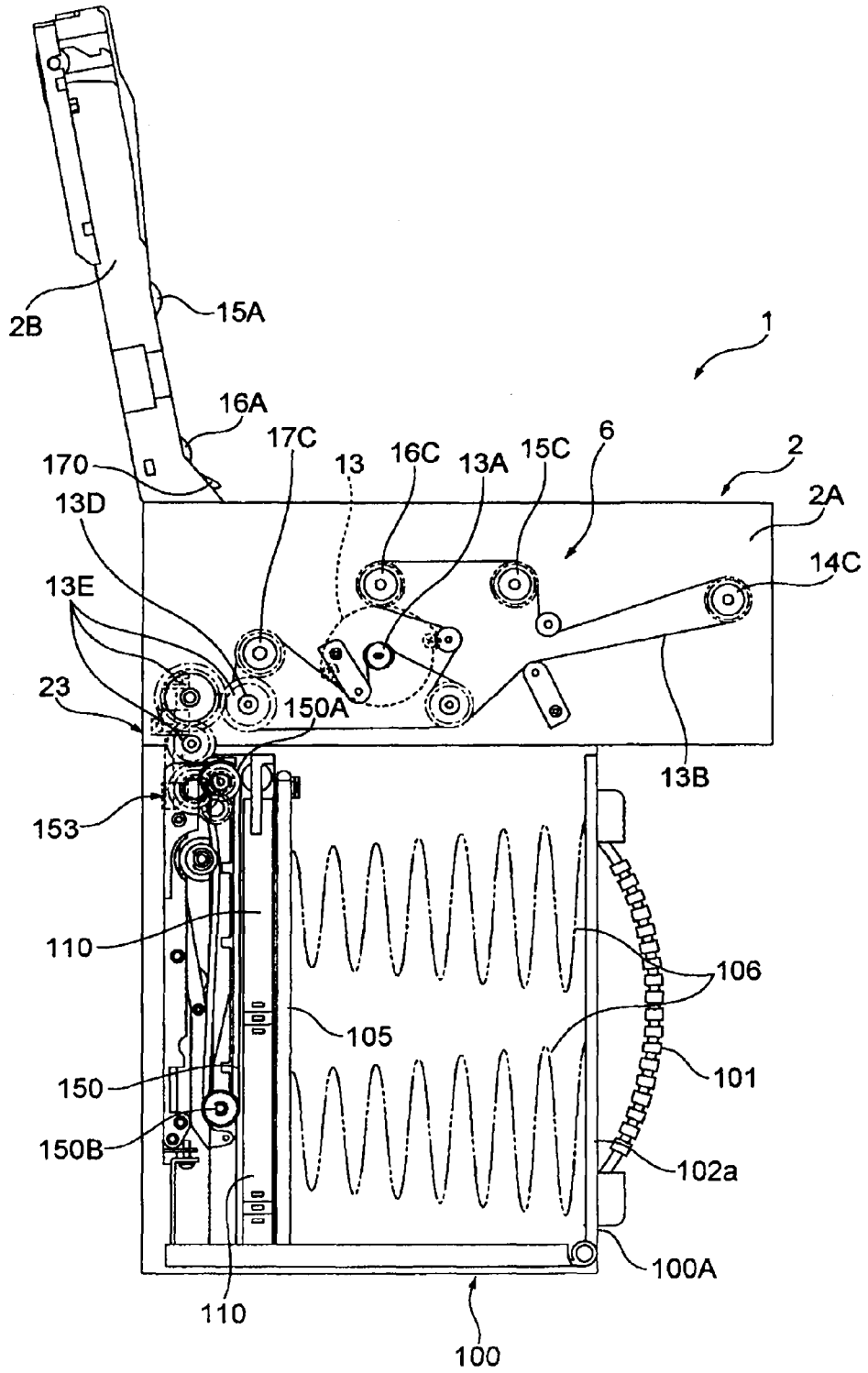
FIG. 5 is a left side view showing a schematic configuration of a driving source and a driving force transmission mechanism to drive a bill conveyance mechanism.
Figure 6:
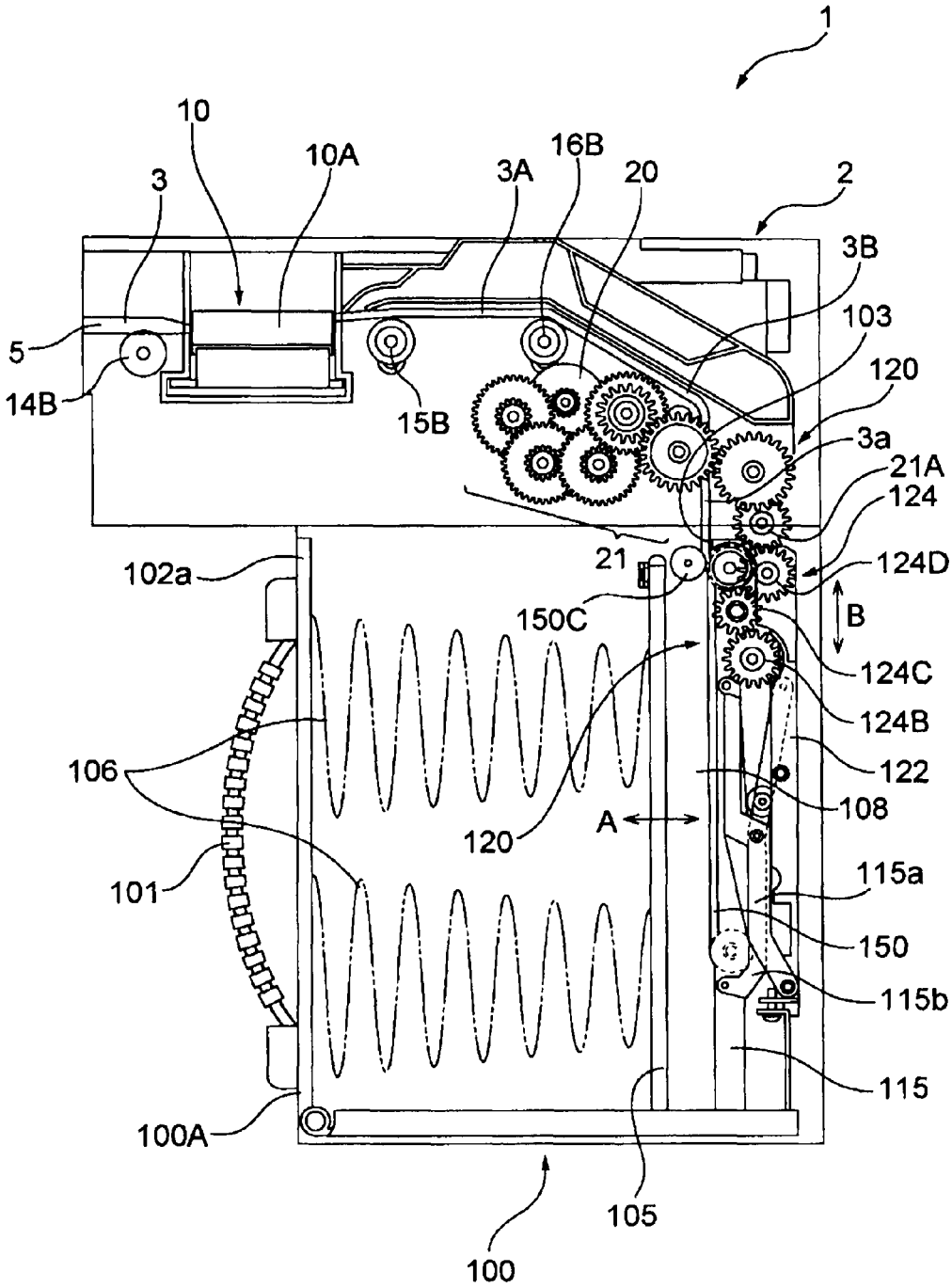
FIG. 6 is a view showing a schematic configuration of a power transmission mechanism for driving a presser plate arranged in a bill housing part.

FIGS. 1 to 6 are diagrams illustrating an embodiment in which a paper sheet processing apparatus according to the present invention is applied to a bill processing apparatus. FIG. 1 is a perspective view showing the entire structure; FIG. 2 is a perspective view showing a state that an open/close member is opened for a main body frame of an apparatus main body; FIG. 3 is a perspective view showing a configuration of a power transmission part of the apparatus main body; FIG. 4 is a right side view schematically showing a traveling route for a bill to be inserted from an insertion slot; FIG. 5 is a left side view showing a schematic structure of a driving source and a driving force transmission mechanism to drive a bill conveyance mechanism; and FIG. 6 is a diagram showing a schematic configuration of a power transmission mechanism to drive a presser plate installed in a bill housing part.

A bill processing apparatus 1 of this embodiment is so configured that it can be incorporated into, for example, various types of gaming machines such as a slot machine and the like, and the bill processing apparatus 1 includes an apparatus main body 2 and a bill housing part (bill housing stacker; cashbox) 100 which is provided to the apparatus main body 2 and is capable of stacking and housing a great number of bills. In this case, the bill housing part 100 may be configured to be mountable to and demountable from the apparatus main body 2, and it is possible, for example, to remove the bill housing part 100 from the apparatus main body 2 by pulling a handle 101 provided on the front face thereof in a state that a lock mechanism (not shown) is unlocked.

As shown in FIGS. 2 and 3, the apparatus main body 2 has a main frame body 2A and an open/close member 2B being configured to be opened and closed for the main body frame 2A by rotating around an axis positioned at one end thereof as a rotating center. Then, as shown in FIG. 4, the main body frame 2A and the open/close member 2B are configured to form a space (bill traveling route) 3 through which a bill is conveyed such that the space is between a bottom face of the open/close member 2B and a top face of the main body frame 2A, both facing with each other across the space, when the open/close member 2B is closed for the main body frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

Also, in the apparatus main body 2, a bill conveyance mechanism 6 that conveys a bill along a bill traveling route 3; an insertion detecting sensor 7 that detects the bill inserted into the bill insertion slot 5; bill reading means 8 that is installed on a downstream side of the insertion detecting sensor 7 and reads out information on the bill in a traveling sate; a skew correction mechanism 10 that accurately positions and conveys the bill with respect to the bill reading means 8; a movable piece passage detecting sensor 12 that detects that the bill passes through a pair of movable pieces 10A constituting the skew correction mechanism; and a discharge detecting sensor 18 which detects that the bill is discharged into a bill housing part 100 are provided.

Hereafter, the respective components described above will be described in detail.

The bill traveling route 3 extends from the bill insertion slot 5 toward the inside, and comprises a first traveling route 3A and a second traveling route 3B extending from the first traveling route 3A toward the downstream side and being inclined downwardly at a predetermined angle to the first traveling route 3A. The second traveling route 3B is bent in a vertical direction on the downstream side and a discharge slot 3*a* from which the bill is discharged into the bill housing part 100 is formed at an end portion on the downstream side such that the bill discharged from the discharge slot 3*a* is fed into a feed port (receiving port) 103 of the bill housing part 100 in the vertical direction. Further, a shutter member 170 that prevents the bill from being conveyed toward the bill insertion slot 5 is installed in the second traveling route 3B in order to prevent fraudulent activity or the like.

The bill conveyance mechanism 6 is a mechanism capable of conveying the bill inserted from the bill insertion slot 5 along the insertion direction and conveying back the bill in an insertion state toward the bill insertion slot 5. The bill conveyance mechanism 6 comprises a motor 13 serving as a driving source installed in the apparatus main body 2; and conveyor roller pairs (14A and 14B), (15A and 15B), (16A and 16B), and (17A and 17B) which are installed with predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to convey the bill toward the back side, as shown in FIGS. 2 and 3, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7.

Thus, the upper conveyor roller 14A is controllably driven to be pressed against or spaced from the lower conveyor roller 14B by a driving source such as a motor and a solenoid. In this case, when a process (skew correction process) for positioning the bill with respect to the bill reading means 8 by eliminating inclination of the inserted bill is executed by the skew correction mechanism 10, the upper conveyor roller 14A is spaced from the lower conveyor roller 14B so as to release the load on the bill, and when the skew correction process is completed, the upper conveyor roller 14A is driven to move toward the lower conveyor roller 14B again to hold (or nip) the bill therebetween.

The conveyor rollers 14B, 15B, 16B and 17B installed on the underside of the bill traveling route 3 are, as shown in FIG. 5, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to convey the bill toward the insertion direction. When the motor 13 is driven to reversely rotate, the conveyor rollers 14B, 15B, 16B, and 17B are driven to reversely rotate in synchronization therewith to convey back the bill toward the bill insertion slot 5 side.

The insertion detecting sensor 7 is to generate a detection signal when a bill inserted into the bill insertion slot 5 is detected. In this embodiment, the insertion detecting sensor 7 is installed between the pair of conveyor rollers (14A, 14B) and the skew correction mechanism 10. The above insertion detecting sensor 7 comprises, for example, an optical sensor, in particular, a regressive reflection type photo sensor. However, the insertion detecting sensor 7 may comprise a mechanical sensor other than the optical sensor.

Further, the skew correction mechanism 10 comprises the pair of movable pieces 10A (only one of the pair members is shown) correcting skew of the bill. The movable pieces 10A have a function to correct an inclination of the bill by touching both sides of the bill to be conveyed as they are driven to get close to or spaced from each other in a direction perpendicular to the bill traveling direction by a motor (skew driving mechanism motor) 40 and via a gear train 41 sequentially engaged with an output shaft 40*a* of the motor 40.

Further, the movable piece passage detecting sensor 12 is to generate a detection signal when it is detected that a front end of the bill passes through the movable pieces constituting the skew correction mechanism 10, and the movable piece passage detecting sensor 12 is installed on the upstream side of the bill reading means 8. The movable piece passage detecting sensor 12 also comprises an optical sensor or a mechanical sensor in the same way as mentioned before with respect to the insertion detecting sensor.

Further, the discharge detecting sensor 18 is to detect a back end of the bill passing through such that it is detected that the bill is discharged into the bill housing part 100. The discharge detecting sensor 18 is disposed just in front of the receiving port 103 of the bill housing part 100 on the downstream side of the second bill traveling route 3B. When the detection signal is transmitted from the discharge detecting sensor 18, the driving by the motor 13 is stopped and the conveyance processing of the bill is terminated. The discharge detecting sensor 18 also comprises an optical sensor or a mechanical sensor in the same way as the aforementioned insertion detecting sensor.

The bill reading means 8 reads bill information on the bill to be conveyed in a state that the skew is eliminated by the skew correction mechanism 10, and judges its validity (authenticity). In detail, for example, the bill reading means 8 may comprise a line sensor that performs reading of the bill such that a bill to be conveyed is irradiated with light from upper and lower sides, and transmitted light therethrough and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be conveyed.

The bill housing part 100 which is so configured as to be mountable to and demountable from the apparatus main body 2 has a function to stack and house sequentially the bills having been identified as being legitimate by the bill reading means 8. Here, the configuration of the bill housing part 100 will be described with reference to FIGS. 7 to 12 in addition to FIGS. 4 to 6.

Figure 7:
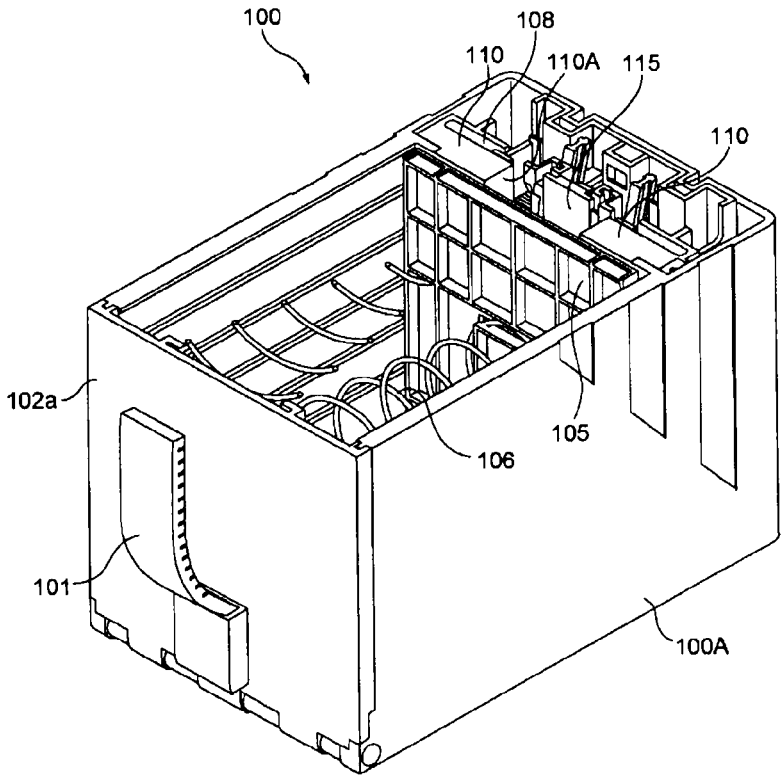
FIG. 7 is a perspective view showing an interior configuration of the bill housing part.
Figure 8:
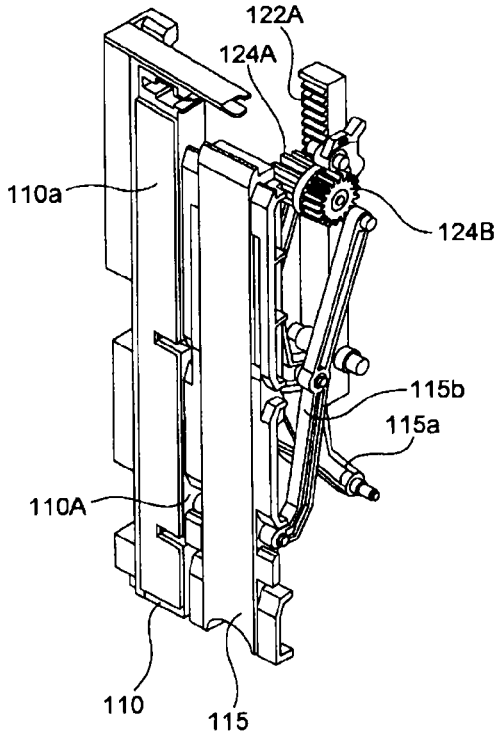
FIG. 8 is a perspective view showing a main part of the inside of the bill housing part in a state that the presser plate is in a standby position.
Figure 9:
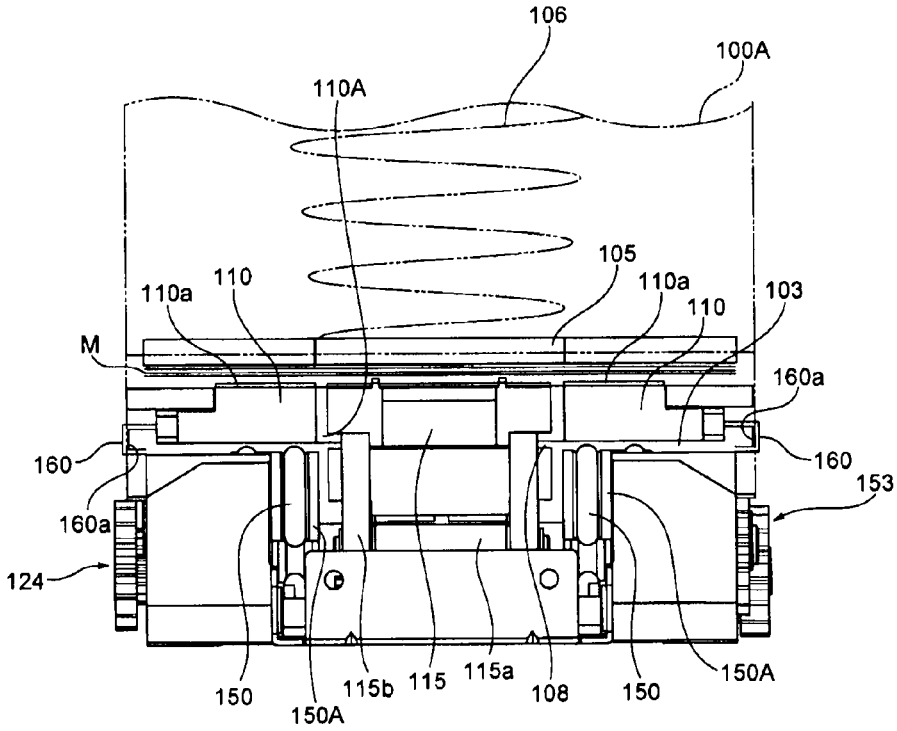
FIG. 9 is a plan view showing a state that the presser plate is in a standby position.
Figure 10:
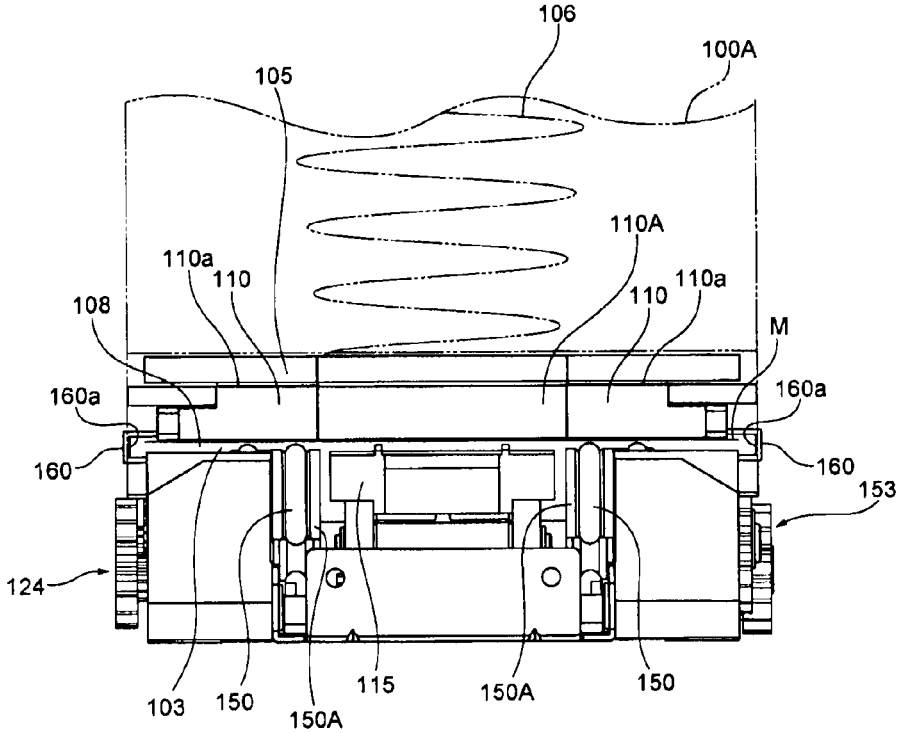
FIG. 10 is a plan view showing a state that the presser plate is in a initial position.
Figure 11:
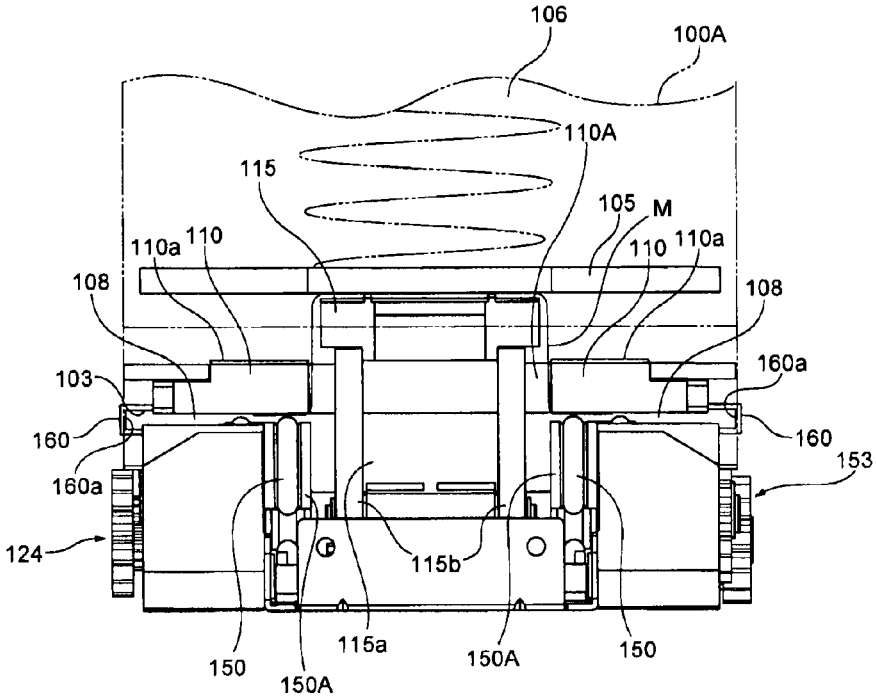
FIG. 11 is a plan view showing a state that the presser plate is pressing a bill.
Figure 12:
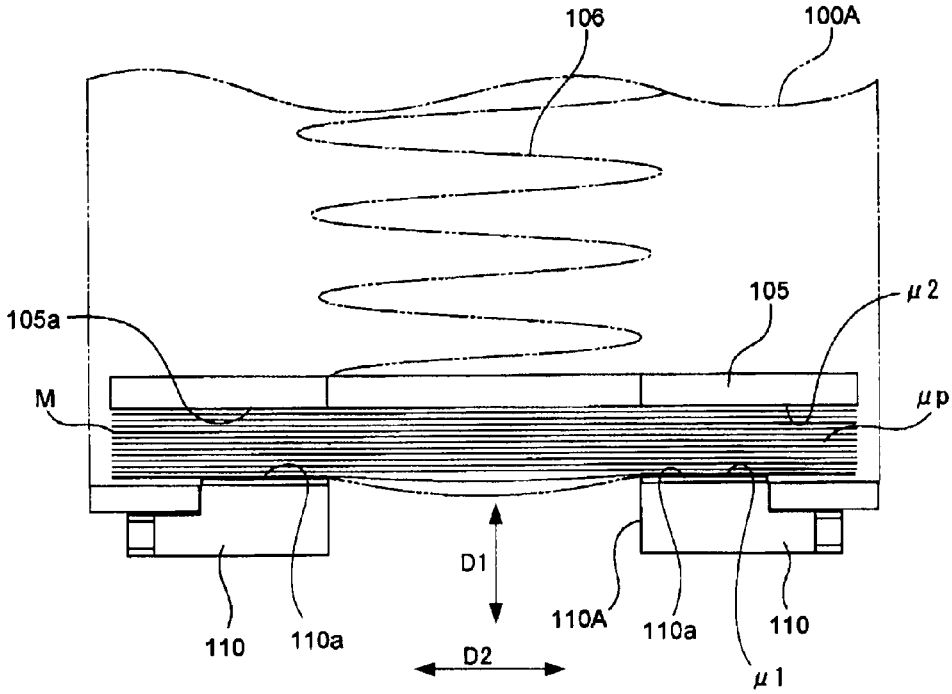
FIG. 12 is a plan view showing a state that many bills are stacked on a placing plate.

In addition, FIG. 7 is a perspective view showing an interior configuration of the bill housing part; FIG. 8 is a perspective view showing a main part of the inside of the bill housing part in a state that the presser plate is in a standby position; FIG. 9 is a plan view showing a state that the presser plate is in the standby position; FIG. 10 is a plan view showing a state that the presser plate is in an initial position; FIG. 11 is a plan view showing a state that the presser plate is pressing a bill; and FIG. 12 is a plan view showing a state that many bills are stacked on a placing plate.

As shown in FIGS. 4 to 7, the main body frame 100A constituting the bill housing part 100 is formed into a substantially rectangular parallelepiped (or cuboid) shape, and one end of bias means (e.g., bias means including a bias spring) 106 is attached to an interior side of a front wall 102*a* thereof, and a placing plate (placing board) 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. A rectangular opening 110A is formed between the pair of regulatory members 110 such that the presser plate 115 passes through the opening as bills are successively stacked onto the placing plate 105.

The presser plate 115 is formed in such a size that it may be capable of reciprocating through an opening 110A formed between the pair of regulatory members 110, and gets into the opening so as to be driven to reciprocate between a position where the bills are pressed against the placing plate 105 (a pressing position) and another position where the press standby part 108 is opened (an initial position).

The presser plate 115 is normally arranged in a state that the opening 110A is closed, that is, in a position (referred to as a standby position) where a bill stacked on the placing plate 105 cannot be drawn out as shown in FIGS. 8 and 9, and then the presser plate 115 is moved to an initial position as shown in FIG. 10 in order to open the press standby part 108 when the process is shifted to an operation of housing the bill. The bill having been identified as legitimate by the bill reading means 8 of the apparatus main body 2 is fed to the press standby part 108 in this state, and then the bill is pushed by the presser plate 115 to reciprocate in the opening such that the bill passes the opening 110A as a center portion thereof is deflected, whereby the bill is sequentially stacked on the placing plate 105. Then, the bill stacked on the placing plate 105 is biased so as to be pressed against respective surfaces (contact faces 110*a*) of the pair of regulatory members 110 by the biasing means 106, to be stably held between the placing plate 105 and the pair of regulatory members 110 (refer to FIG. 12).

In addition, the respective contact faces 110*a* of the regulatory members 110 by which a bill M is regulated are so configured that a coefficient $\mu 1$ of friction on the contact faces 110*a* is higher than a coefficient $\mu p$ of friction between a bill and a bill ($\mu 1 > \mu p$). Concretely, in this embodiment, the contact faces 110*a* are so configured that rubber is attached thereto in order to increase the frictional force on the surfaces of the regulatory members. And, in this embodiment, a contact face 105*a* of the placing plate on which the bill contacts is also configured such that a coefficient μ2 of friction on the contact face 105*a* is higher than the coefficient μp of friction between the bill and the bill (μ2>μp) in a similar manner in a similar manner as shown in the case of the regulatory member.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIGS. 4 and 6, and these link members 115*a* and 115*b* are connected in a shape of letter "X", and the other ends opposite to the respective ends are supported pivotally by a movable member 122 installed movably in a vertical direction (an arrow B direction). A rack 122A is formed in the movable member 122, and a pinion 124A constituting the presser plate driving mechanism 120 is geared (engaged) with the rack 124A.

As shown in FIG. 6, a housing part side gear train 124 constituting the presser plate driving mechanism 120 is connected to the pinion 124A. For this case, in this embodiment, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion 124A and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack 122A installed onto the movable member 122, and the link members 115*a*, 115*b*, etc.).

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 5, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

Guide members 160 regulating the both side edges of the bill are formed to extend along the conveying-in direction of the bill from the receiving port 103 in the main body frame 100A. The guide members 160 have U-shaped guide faces 160*a* being installed on the lateral end portions and regulating the both side edges of the bill to be conveyed in. The U-shaped guide faces 160*a* are arranged to lie on respective sides such that openings thereof face each other. When the bill is conveyed inside the bill housing part (the press standby part 108) from the receiving port 103, the guide faces 160*a* allow the bill to move along the guide member 160, and the bill and the pair of belts 150 can slidingly contact each other stably.

The bill processing apparatus provided with the bill housing part 100 having the above-described configuration operates as follows.

First, the above-described conveyor roller pair (14A and 14B) is in a state that the rollers are spaced from one another in an initial state, and the presser plate 115 is, as shown in FIG. 9, located inside the opening 110A of the pair of regulatory walls 110 (standby position), to effectively prevent a fraudulent activity such as drawing of the bill or the like.

When insertion of the bill is detected in this condition by the insertion detecting sensor 7, the driving motor 20 of the above-described presser plate 115 is driven to rotate reversely for a predetermined amount to move the presser plate 115 to the initial position as shown in FIG. 10 such that the press standby part 108 is released (opened). Then, the upper conveyor roller 14A installed in the bill insertion opening part is moved to contact with the lower conveyor roller 14B, and the bill is nipped and held by the pair of conveyor rollers (14A and 14B).

In this condition, the bill conveyor motor 13 is driven to rotate normally, to convey the bill toward the inside of the apparatus, and when the movable piece passage detecting sensor 12 detects the leading end of the bill, the driving of the motor 13 is stopped and the pair of movable pieces 10A are driven to correct an inclination of the bill by the motor 40 for the skew driving mechanism in the skew correction mechanism 10.

After the skew of the bill is corrected by the skew correction mechanism 10, the motor 13 is again driven to normally rotate to convey the bill, and a bill reading process is executed when the bill passes the bill reading means 8. In this bill reading process, when the bill is judged as legitimate, the bill is conveyed in the same condition as it is toward the bill housing part 100, and when the trailing end of the bill is detected by the discharge detecting sensor 18, the driving of the motor 13 is stopped. At this time, the bill is in a state of being fed in the press standby part 108. In addition, when the bill is judged as counterfeit in the bill reading means 8, the motor 13 is driven to rotate reversely, to discharge the bill from the bill insertion slot.

Then, after the driving of the motor 13 is stopped, the motor 20 is driven to rotate normally for a predetermined amount in order to place the bill on the placing plate 105. At this time, as shown in FIGS. 10 and 11, the bill is pressed against the placing plate 105 by the presser plate 115, to pass through the opening 110A such that the center of the bill is deflected, and sequentially stacked on the placing plate 105 after getting through the opening 110A. Bills stacked on the placing plate 105 are biased so as to be pressed against the respective surfaces (contact faces 110*a*) of the pair of regulatory members 110 by the biasing means 106, and as shown in FIG. 12, the bill is prevented from sliding such that the bill may not deflect (or sag) due to the frictional force on the contact faces 110*a*, and stably held between the placing plate 105 and the pair of regulatory members 110 even when vibration, impact, or the like is caused.

Thereafter, the presser plate 115 is driven toward the press standby part as shown in FIG. 9, and a series of bill housing operations is completed.

As described above, the respective contact faces 110*a* of the pair of regulatory members 110 that regulate movement of the bill are so configured that rubber is attached thereto in order to increase a coefficient of friction thereon. Since the coefficient μ1 of friction on the contact faces 110*a* made of rubber is higher than the coefficient μp of friction between the bill and the bill being stacked or laminated, it is unlikely that the laminated bill slides on the contact faces 110*a*, and the bills are prevented from deflecting down in the opening 110A.

That is, as schematically shown in FIG. 12, the bills are sequentially laminated in the direction of arrow D1 by repeating the convey-in operation, and forcibly pressed against the contact faces 110*a* by the placing plate 105 to which the biasing force of the biasing means 106 is applied. At this time, as the number of laminated bills on the placing plate 105 increases, the laminated bills show a tendency to deflect downward into the opening 110A as shown by the dotted line in the drawing. However, since the coefficient μ1 of friction of the contact faces 110*a* is arranged to be higher than the coefficient μp of friction between the bills as described above, the bills are prevented from deflecting downward in the opening 110A as shown by the dotted line.

As a result, due to the contact faces 110*a* imparting the friction force higher than the friction force between the bills, the bills housed so as to be sequentially laminated on the placing plate 105 are stably accumulated without causing an accumulation failure by deflecting downward in the opening 110A even when vibration, impact, or the like is caused.

Further, as shown by the dotted line, since the presser plate 115 in the standby position inside the opening 110A as described above is not deviated toward the initial position by the bills deflecting downward, the presser plate 115 can always be stopped and stay in the exact standby position such that the driving control of the presser plate may be accurately performed.

Moreover, in the above-described embodiment, since the contact faces 105*a* of the placing plate 105 are also configured such that the coefficient μ2 of friction thereof is arranged to be higher than the coefficient μp of friction between the bills, even when the bills are laminated one after another, the bottom bill does not slide on the placing plate and, in particular, it does not slide in the width direction in which a collapse thereof is caused at the time of accumulating the bills (the direction of arrow D2 in FIG. 12), whereby the bill can be stably accumulated on the placing plate.

Figure 13:
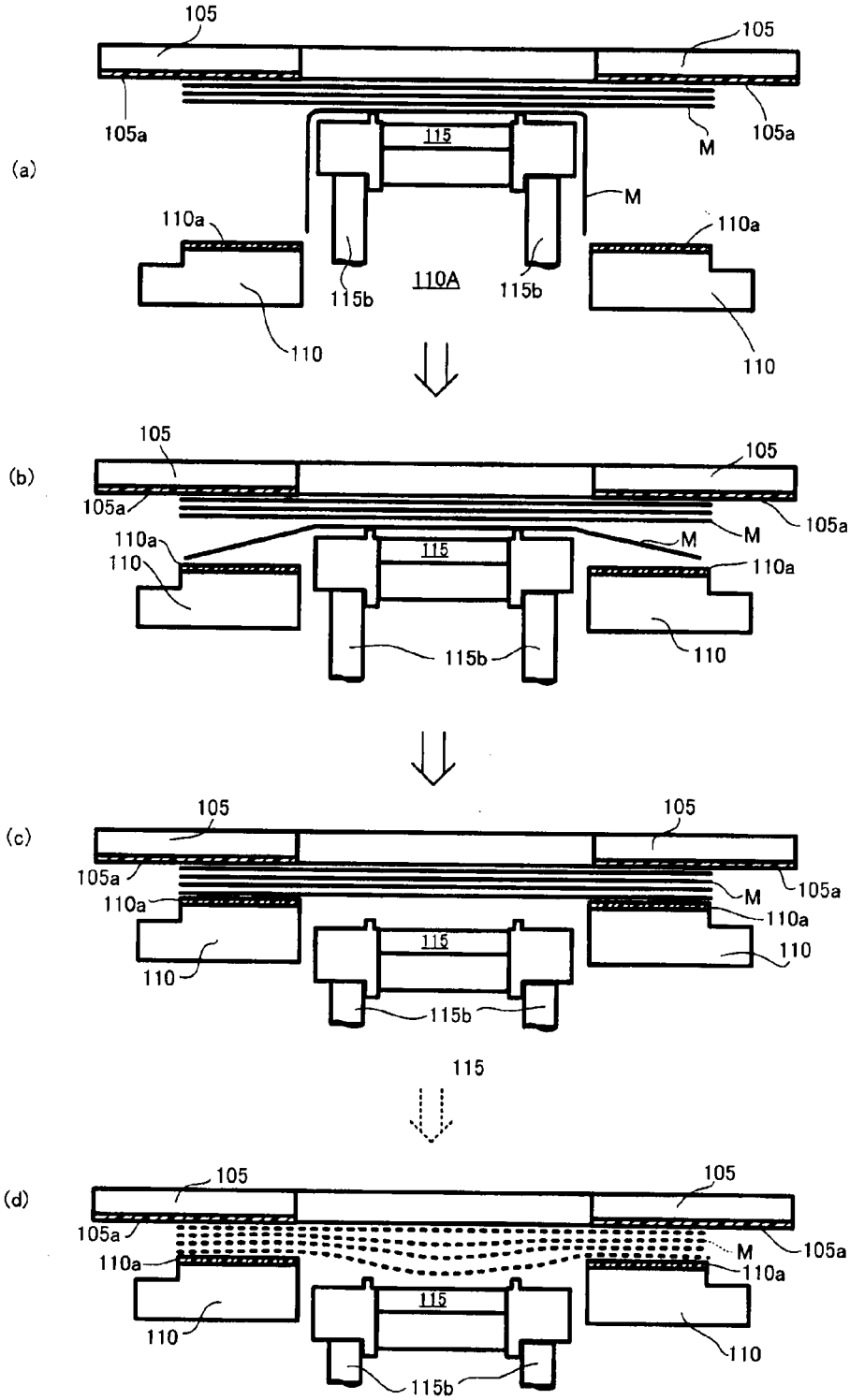
FIG. 13 is a schematic diagram illustrating a housing process when many bills are stacked on the placing plate.

FIG. 13 illustrates the situation in which the presser plate 115 is moved to pass through the opening 110A by the link member 115*b*. FIG. 13 shows a state (a) in which three bills M are already stacked and placed to be laminated and the fourth bill M is now passing through the opening 110A and pressed against the laminated three bills M by the presser plate 115. The opening 110A is narrower than the bill M, and therefore, the fourth bill M is provided with folding portions folded near-vertically on both sides thereof. The presser plate 115 pushed out by the link member 115*b* contacts the placing plate 105 via the bills M placed so as to be laminated, and presses up the placing plate 105 upward in the drawing against the biasing means 106 (FIG. 12 and so on) biasing the placing plate 105. Thus, the folding portions on the both sides of the fourth bill M pass through the opening 110A defined by the regulatory members 110 to enter the housing part. Then, the folding portions are slightly stretched laterally due to springback (elastic recovery) or the like of the bill, and appear in a widely opened V-shape if viewed in a top view.

Next, when the link member 115*b* lowers the position of the presser plate 115 in the drawing, the placing plate 105 is pushed down by the biasing means 106 so as to move downward along with the bills M placed and laminated thereon. At this time, the bills M receive wind pressure from the lower side. In particular, since the fourth bill M receives the wind pressure in the direction in which the folding portions are opened, the bill is opened to be formed into an even widely opened V-shape in association with the restoring force of the folded portions (state (b)). Moreover, when the link member 115*b* lowers the presser plate 115 downward in the drawing, the placing plate 105 is pushed down by the biasing means 106, and the fourth bill M is made substantially flat, to be placed so as to be laminated along with the other bills, and is sandwiched between the placing plate 105 and the contact faces of the regulatory members 110 (state (c)). Accordingly, it is preferable that the movement of the placing plate 105 according to the downward movement of the presser plate 115 is performed at a speed in which the fourth bill M receives wind pressure sufficiently such that the folding portions of the top bill M can be sufficiently opened. Further, it is preferable that, in order to make the most of the pressing effect on the central portion of the bill M to be placed and laminated by the presser plate 115, the downward moving speed of the presser plate 115 is drastically slowed down when the pressing surface of the presser plate 115 pressing the bills M becomes at substantially the same height as the contact faces 110*a* of the regulatory members 110, to press the central portion of the bills M placed and laminated. For example, the following model may be considered. Here, the placing plate 105 and the bills M move downward at substantially the same speed as the presser plate 115 moves downward in the drawing, and when the presser plate 115 stops its movement suddenly, a momentum mv of the presser plate 115 with mass m is 0 because the speed is 0. Therefore, since the impulse is mv and the mass m is great, high pressing force is applied onto the plurality of bills placed on the placing plate 105. Therefore, the laminated body whose central portion is loose as shown in the state (d) in FIG. 13 may also be pressed on its central portion so as to be stretched towards the both side ends such that the laminated body may be sandwiched by the contact faces 110*a* of the regulatory members 110 and the contact faces 105 of the presser plate 115 in a stretched condition.

Here, the contact faces 105*a* contacting the bill M are arranged on both sides of the placing plate 105 and are formed with a material such as rubber and the like having a high coefficient of friction with a paper or the like such as a bill. The contact faces 110*a* of the regulatory members 110 at the positions facing the contact faces 105*a* are also, in the same way, formed of a material such as rubber or the like having a high coefficient of friction with a paper or the like such as a bill. Since these contact faces are formed of such a material, the ends on the both sides are fixed by these contact faces 105*a* and 110*a* nipping the both ends of one or more sheets of the bills M, and therefore, it is easy to maintain the tensile force of the bills M. Accordingly, as in the state (c), even when the presser plate 115 completely detached from the bill M, it is unlikely that the bills M placed and laminated swell out in the vicinity of the opening 110A. On the other hand, in the case where the coefficient of friction of the contact faces 105*a* and 110*a* with the bills M is the same as or lower than the coefficient of friction between the bills M, it is easy for the respective bills M to slide on these contact faces 105*a* and 110*a*. Therefore, as shown in the state (d), it is easy for the bills M (in particular, the top bill M (corresponding to the fourth)) to deflect in the vicinity of the opening 110A. Therefore, as shown in the state (d), it is easy for the bills M (in particular, the top bill M (corresponding to the fourth)) to deflect in the vicinity of the opening 110A.

Here, a meaning of the coefficient of friction is considered. The coefficient of friction means a ratio of the horizontal frictional resistance force to the vertical pressing force. That is, the frictional force theoretically becomes zero (0) if the vertical pressing force is zero (0). As described above, when the presser plate 115 passes through the opening 110A to move along with the bills M by the link member 115*b*, since the vertical pressing force onto the both end sides of the bills M placed and laminated is zero in the state (a), there is no frictional force, and therefore, the both ends can move rather freely. On the other hand, with respect to the central portion (the portion corresponding to the opening 110A), the pressing force is applied onto the bills M sandwiched by the placing plate 105 and the presser plate 115, and frictional resistance force thereon is generated in proportion to the pressing force. However, since it is rather preferable that the frictional force onto the central portion is low, the portion corresponding thereto is not formed of a material such as rubber or the like having a high coefficient of friction with a paper or the like such as a bill as described above. Then, in the state (b), since the presser plate 115 moves downward, the pressing force may be lower than that when the presser plate 115 moves upward, the central portion of the bills M placed and laminated may be considered to start expanding due to its own restoring force. Then, in the state (c), the pressing force onto the central portion of the bills M placed and laminated is released. However, on the other hand, since the both end sides are pressed by the biasing means 106 to be sandwiched by the contact faces 105*a* and 110*a*, the respective bills M get tied up by vertical press force based on this sandwiching force and the resistance force (frictional force) generated between the bills M and the contacting surfaces. In more detail, since the fourth bill M is on the outermost surface, the fourth bill M contacts the contact faces 110*a* of the regulatory members 100 and is subject to the pressing force so as to resist against the force acting in the horizontal direction on the surface with the frictional force. On the other hand, the top bill M (here, the first one as a matter of convenience) in the drawing contacts the contact faces 105*a* of the placing plate 105 with the both sides thereof, to receive the pressing force, and resists the force acting in the horizontal direction onto the contact faces 105*a* with the frictional force. In this way, provided that the coefficient of friction between the bill M and the contact faces 105*a*, 110*a* is high, it is possible to maintain these bills straight so as not to deflect them against the force horizontally acting on the respective contact faces (mainly, the tensile force onto the central portion based on the restoring force of the central portion of the bills M). On the other hand, since the bills M sandwiched therebetween contact other bills, the bills M receive the pressing force via the top or outermost surface bill M, and resist the force acting in the horizontal direction on the contact faces of the respective bills (mainly, the tensile force onto the central portion based on the restoring force of the central portion of the bills M) with the frictional force. Since the coefficient of friction between the contact faces of the respective bills is lower than the coefficient of friction between the bill M and the contact faces 105*a*, 110*a*, the resistance force against substantially the same pressing force and substantially the same force acting in the horizontal direction (mainly, the tensile force onto the central portion based on the restoring force of the central portion of the bills M) is made lower.

As mentioned above, the embodiment of the present invention is described. However, the present invention is not limited to the above-described embodiment, and various modifications of the present invention can be implemented. In the above-described embodiment, the contact faces 110*a*, 105*a* of the regulatory members 110 and the placing plate 105*b* contacted by the bills are so configured that the member (rubber or the like) having a high coefficient of friction may be attached thereto. However, it is not necessary to attach such rubber to the entire contact faces.

Further, the respective contact faces of the regulatory members 110 and the placing plate 105 are so configured that different members are attached thereto. However, the respective regulatory members and the placing plate themselves may be formed with a material having a high coefficient of friction, or a surface treatment (for example, surface texturing, embossing finish, or the like) may be applied only onto the contact faces thereof so as to have such a high friction coefficient.

Further, the present invention has a feature in the portion of regulating the movement of the bills (the contact faces with bills) in the bill housing part in which bills having been inserted into the bill insertion slot 5 and judged as legitimate are laminated and housed, and the other configurations may be appropriately modified. For example, the lamination of the bills is so configured that the bills are set vertically and pressed. However, the bills may be stacked from the lower side and pushed up by laminating the bill so as to be housed.

In the above-described embodiment, a paper sheet processing apparatus includes a housing part which is capable of housing a paper sheet inserted into an insertion slot, and the housing part comprises a regulatory member including an opening for receiving a paper sheet to be stacked and housed, and a contact face for regulating movement of the paper sheet to which the paper sheet is contacted, and then the regulatory member is arranged such that a coefficient of friction on the contact face contacted by a paper sheet is higher than a coefficient of friction caused between paper sheets to be stacked and housed.

In accordance with the bill processing apparatus having the above-described configuration, when a bill is inserted thereinto and identified as being valid, for example, the bill is conveyed to a bill housing part installed on the downstream side therefrom. The paper sheet fed into the housing part passes through the opening formed between the regulatory members so as to deflect, and is housed and laminated in a state that the paper sheet contacts the contact faces of the regulatory members. At this time, since the contact faces of the regulatory members regulating the paper sheet are made to have a coefficient of friction higher than the coefficient of friction caused between the paper sheets housed and laminated, a paper sheet contacting the contact faces so as to be regulated does not slide on another paper sheet under it, such that the paper sheets are prevented from deflecting downward into the opening formed between the regulatory members. Accordingly, even when vibration, impact, or the like is caused in the housing operation, it is unlikely that the accumulation failure of the paper sheets is caused such that the paper sheets may be stably accumulated.

Further, the housing part includes a placing plate on which paper sheets are placed and laminated, the laminated paper sheets being positioned between the placing plate and the regulatory members. And the placing plate may be configured such that the coefficient of friction of the contact faces contacted by paper sheets is higher than the coefficient of friction caused between the paper sheets themselves housed and laminated.

In such a configuration, since the contact faces of the placing plate contacted by paper sheets are so configured as to have a coefficient of friction higher than the coefficient of friction caused between the paper sheets themselves housed and laminated on the placing plate, the paper sheets to be laminated do not slide on the placing plate. Accordingly, the laminated state of the paper sheets on the placing plate does not collapse in the housing operation, and it is even unlikely that the accumulation failure of the paper sheets is caused such that the paper sheets may be stably accumulated.

According to the present invention, a paper sheet processing apparatus capable of accumulating paper sheets in a stable condition may be provided.

The present invention can be applied not only to the bill processing apparatus, but also to a device which provides products and services when the paper sheet such as a service ticket and a coupon ticket, for example, is inserted.

What is claimed is:

1. A paper sheet processing apparatus comprising:

a housing part capable of housing a paper sheet which is inserted throw an opening narrower than the paper sheet;

a pair of regulatory members which define both side edges of the opening;

a presser plate which pushes the paper sheet to move through the opening into the housing part;

a placing plate on which the paper sheet to be pressed by the presser plate is placed;

a biasing member which biases the placing plate against the presser plate;

a pair of contact faces which are disposed on both sides of the opening so as to oppose to the placing plate; and a motor which drives the presser plate wherein a moving speed of the presser plate is reduced in a vicinity of the opening by controlling the motor when the presser plate having been pushed out of the housing part moves into the opening, wherein the presser plate repeats a reciprocal movement passing through the opening such that a plurality of paper sheets are stacked between the placing plate and the pair of contact faces in the housing part, and the contact faces have a greater coefficient of friction as compared to a coefficient of friction between the paper sheets.

2. A paper sheet processing apparatus comprising:

a housing part capable of housing a paper sheet which is inserted through an opening narrower than the paper sheet;

a pair of regulatory members which define both side edges of the opening;

a presser plate which pushes the paper sheet to move through the opening into the housing part;

a placing plate on which the paper sheet to be pressed by the presser plate is placed;

a biasing member which biases the placing plate against the presser plate;

a pair of contact faces which are disposed on both sides of the opening so as to oppose to the placing plate; and a motor which drives the presser plate wherein a moving speed of the presser plate is reduced in a vicinity of the opening by controlling the motor when the presser plate having been pushed out of the housing part moves into the opening, wherein the presser plate repeats a reciprocal movement passing through the opening such that a plurality of paper sheets are stacked between the placing plate and the pair of contact faces in the housing part, the contact faces have a greater coefficient of friction as compared to a coefficient of friction between the paper sheets, and the placing plate has a contact surface having a greater coefficient of friction as compared to the coefficient of friction between the paper sheets.

3. A paper sheet processing apparatus comprising:

a housing part capable of housing a paper sheet which is inserted through an opening narrower than the paper sheet;

a pair of regulatory members which define both side edges of the opening;

a presser plate which pushes the paper sheet to move through the opening into the housing part;

a placing plate on which the paper sheet to be pressed by the presser plate is placed;

a biasing member which biases the placing plate against the presser plate;

a pair of contact faces which are disposed on both sides of the opening so as to oppose to the placing plate; and a motor which drives the presser plate wherein a moving speed of the presser plate is reduced in a vicinity of the opening by controlling the motor when the presser plate having been pushed out of the housing part moves into the opening, wherein the presser plate repeats a reciprocal movement passing through the opening such that a plurality of paper sheets are stacked between the placing plate and the pair of contact faces in the housing part, the contact faces have a greater coefficient of friction as compared to a coefficient of friction between the paper sheets, and the placing plate pushes the pair of contact faces across the housing part when the presser plate does not press the paper sheet.

* * * * *